United States Patent [19]

Roy

[11] 4,122,965

[45] Oct. 31, 1978

[54] LINERLESS CLOSURE

[75] Inventor: Gerald L. Roy, Lancaster, Pa.

[73] Assignee: Kerr Glass Manufacturing Corporation, Lancaster, Pa.

[21] Appl. No.: 813,622

[22] Filed: Jul. 7, 1977

[51] Int. Cl.[2] ..... B65D 53/00

[52] U.S. Cl. ..... 215/344; 215/345; 215/DIG. 1

[58] Field of Search ..... 215/344, 329, DIG. 1, 215/343, 345, 346

[56] References Cited

U.S. PATENT DOCUMENTS

| | | | |
|---|---|---|---|
| 2,768,762 | 10/1956 | Gurnet | 215/344 |
| 2,886,198 | 5/1959 | Herter | 215/DIG. 1 |
| 3,053,406 | 9/1962 | Wandell | 215/344 |
| 3,074,579 | 1/1963 | Miller | 215/DIG. 1 |
| 3,151,757 | 10/1964 | Martin | 215/344 |
| 3,215,297 | 11/1965 | Acton et al. | 215/DIG. 1 |
| 3,232,470 | 2/1966 | Gibson | 215/DIG. 1 |
| 3,255,909 | 6/1966 | Miller et al. | 215/344 |
| 3,370,732 | 2/1968 | LaVange | 215/344 |
| 3,586,196 | 6/1971 | Barton | 215/344 |
| 3,844,439 | 10/1974 | Demers et al. | 215/344 |

FOREIGN PATENT DOCUMENTS

| | | | |
|---|---|---|---|
| 1,482,569 | 6/1969 | Fed. Rep. of Germany | 215/329 |
| 2,306,895 | 11/1976 | France | 215/344 |
| 695,690 | 8/1953 | United Kingdom | 215/344 |
| 788,148 | 12/1957 | United Kingdom | 215/344 |

*Primary Examiner*—William Price
*Assistant Examiner*—Allan N. Shoap
*Attorney, Agent, or Firm*—Fitch, Even, Tabin & Luedeka

[57] ABSTRACT

A closure for glass containers is formed with a top end wall and a depending annular skirt wall. A base ring depends downwardly from the top end wall and supports a small sealing fin which projects downwardly from base ring to engage the finish of a glass container neck in sealing relation when the closure is applied to the container. The preferred base ring is tapered downwardly and outwardly and facilitates the flow of plastic into the sealing fin during molding of the closure. The closure is threaded onto the container neck and the sealing fin comes into contact with the finish. The application of additional closure torque causes the sealing fin to deform and be crushed. Polypropylene has the desired structural properties of flexural stiffness, hardness and compressive strength to be used for the closure.

6 Claims, 5 Drawing Figures

LINERLESS CLOSURE

The present invention relates generally to a linerless closure and more particularly to a linerless closure molded of plastic with an integral sealing fin for sealing engagement with a glass container finish.

A one-piece, linerless closure, which provides a tight seal despite the imperfections in the surface of the glass container finish, has long been a goal of the container industry. A number of proposals have been made in the past. Most of the currently available linerless closures rely upon a seal made by means of deflection of a flexible fin depending from the top wall of the closure. The lateral flexing movement of the flexible sealing fin is designed to bias the tip of the sealing fin into sealing engagement with the container finish. An example of this type of linerless closure is found in U.S. Pat. No. 3,255,909 to Miller et al. The problem with this type of linerless closure is that the sealing portion of the closure remains under compressive loading and after storage for a period of time the plastic tends to relieve the compression by cold flow movement. The seal is then either lost and the container tends to leak or the unloading torque to release the closure becomes very low.

The present invention is directed to the different approach from the flexing and is particularly concerned with the actual crushing of a sealing fin to fill the imperfections in the glass finish caused by mold release agents or shears during bottle manufacture. The crushing of the sealing fin into sealed relationship with the glass finish is attained with the usual capping machine torques of about 15 to 25 inch/pounds. By tapering the sealing fin and providing a sealing fin with a relatively thin cross section the loading forces applied by the capping machines may be sufficient to generate the cold plastic flow crushing action to form the seal. Such a closure must have good strength to withstand the forces generated and the crushable fin must not be too hard of a material or it will not deform to the irregularities of the glass finish. Also, the flexural stiffness of the closure materials should be sufficiently high that the closure threads will not strip during the capping operation. Good flexural stiffness also prevents relaxation of the plastic under continued loading which would lose the effective seal when the closed container has been on the shelf for a considerable period of time.

In addition to the structural and physical requirements for the closure, it is preferred that the closure be mass produced with present state of the art plastic closure molding machines. In order to be successful, the machines must be capable of producing the closures at a cost not greater than the conventional closures having individual and separate liners for sealing with the glass finish.

Accordingly, a general object of the present invention is to provide a linerless container closure having a crushable seal fin for physical flowing into imperfections in the finish of the glass container to provide a tight seal therewith.

Another general object of the invention is to provide an improved combination of a linerless closure in the glass container.

Other objects and advantages of the present invention will become more apparent from the following detailed description and the accompanying drawing in which.

Figure 1:
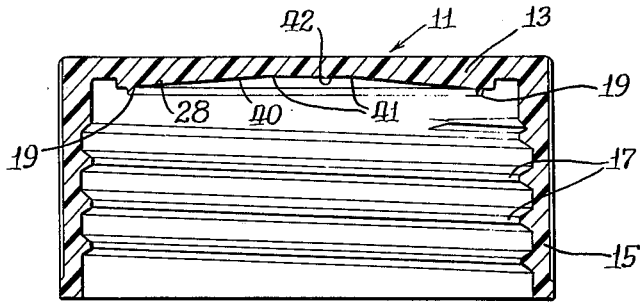
FIG. 1 is a cross-sectional view of a linerless closure embodying novel aspects of the invention.

Referring now to the drawings and more particularly to FIG. 1, the invention is embodied in a closure 11 having a top end wall 13 and an integral depending annular skirt wall 15. Integrally formed on the interior of the skirt wall are screw threads 17 for threaded engagement with external threads 23 of a glass container 24. A substantially rigid sealing fin 19 with a V-shaped cross section depends downwardly from the top end wall 13 to engage the upper top wall or finish 25 of the container in sealing relationship when the closure is applied to the container.

The present invention has a rigid sealing fin 19 in contrast to the present commercial sealing fins which are flexible and shaped to be bent laterally by the glass finish so that it is the flexing of the fin which is important to maintaining the seal. It has been found, however, that such compressive loading of a flexible fin deteriorates when in storage for a long period of time because the plastic tends to relieve the compression by cold flow movement. The seal is either then lost or the unloading torque for releasing the closure becomes lower than desired. Thus, there is a need for an improved type of non-flexing sealing fin for linerless closures.

In accordance with the present invention, a very rigid sealing fin 19 is provided for being crushed into imperfections 27 in the glass finish 25 so as to conform thereto by filling the holes and imperfections in the glass finish thereby resulting in a liquid leakproof seal. This is achieved by making a small annular sealing fin of a material which is sufficiently soft and configured to be crushed, that is, to deform in response to the shear forces encountered, and yet has the requisite structural stiffness required for a closure being applied by automated capping machines. To provide additional strength and rigidity to the top end wall and to facilitate flow of the plastic into the relatively small cross-sectional sealing fin, a base ring means 28 is formed behind the sealing fin and depending from the top end wall 13. As will be explained in greater detail, the preferred base ring means 28 has a generally tapered cross-sectional thickness to facilitate the flowing of plastic into the thin crushable fin and to provide additional strength at the location where the greatest loads are being transmitted to the top end wall 13.

Referring now in greater detail to the illustrated closure shown in FIG. 1, the sealing fin 19 is defined by two downwardly tapering side walls 31 and 32 which intersect to define an included angle therebetween. The preferred included angle is between approximately 40° to 60°. Preferably, each of the side walls 31 and 32 define an angle of about 20° with a vertical line taken through the sealing fin and disposed perpendicularly to the top end wall 13 of the closure 11.

The sealing fin 19 is made relatively small so that the shear loadings applied thereto by the automated capping machines will shear, i.e., crush in the sense of permanently deforming, the fin. The illustrated sealing fin 19 is formed with a generally flat end wall 35 of about 0.003–0.005 of an inch thick and is about 0.010 of an inch in height. During the course of crushing fin sealing wall 35 into the imperfections and across the container finish 25, the fin sealing wall widens substantially beyond its original 0.003–0.005 inch thickness and thus is permanently deformed and retains this wider width when the closure is removed from the container. The height and width of the sealing fin and the width of the end sealing wall 35 may be varied from that of the preferred embodiment so long as the sealing fin can be filled and crushed to make the seal. In the illustrated closure, the sealing fin 19 is formed with a diameter of about 1.182" for a cap having overall outside diameter of about 1.576" diameter. Manifestly, different sizes of closures will have different sealing fin diameters and the above dimensions are merely as of the illustrated closure.

Figure 2:
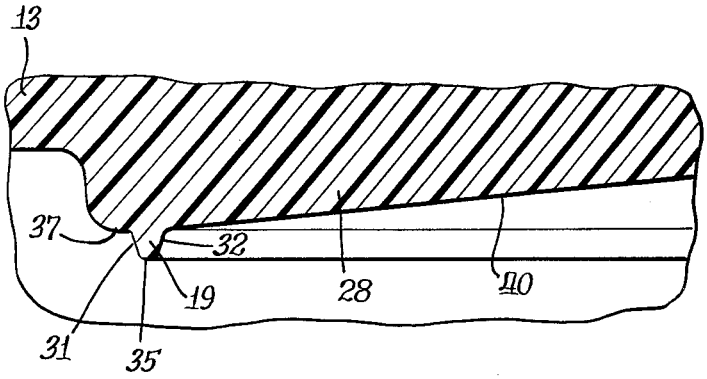
FIG. 2 is an enlarged fragmentary cross-sectional view of a sealing fin and a supporting base ring means for the closure of FIG. 1.

Considerable difficulty arises in attempting to mold these small crushable sealing fins 19 as the plastic tends to flow past the sealing fin mold cavity and into the depending skirt walls 15. A skin is thus formed on the plastic making later penetration of the plastic into the sealing fin cavity more difficult at the latter stages of the molding process. The preferred sealing ring means 28 is tapered downwardly and outwardly toward the sealing fin 19 to the encircling sealing fin 19 and the plastic tends to flow down along this tapered wall in the mold and then to continue its downward flow into the depending seal fin, as best seen in FIG. 2. Herein, the tapered cross-sectional thickness for the base ring means 28 is defined by a general frustum of a cone surface 40 which extends from an inner diameter 41 to the juncture with the base of the fin 19. As best seen in FIG. 2, the thickness portion of the base ring means 28 is disposed at and slightly radially outwardly of the base of the sealing fin 19. Herein, the ring base means 28 is preferably about 0.025 inch in thickness at its greatest thickness. By way of example only, the angle for the surface 40 is about 5° as measured from the horizontal. Herein, a flat central circular area is located at the axis of the closure and this flat area 42 is, in this instance, about 0.305" in diameter and located at the central axis of the closure.

The increasing of the cross-sectional thickness by the ring base means 25 is preferably kept to a minimum consistent with the strength and flow requirements so as to reduce the amount of cooling time of the closures in the mold. The amount of cooling time required is increased with an increase in thickness of the thickest wall. Therefore, the cooling time may become prohibitive if one makes the back up support for the crushable fin too thick.

In order that the closure material actually crush and conform to the closure surface during the shearing action, the material selected for the closure should not be too hard or it will not be crushed by the torques imposed by the capping machine to the closures. It has been found that the preferred hardness for the sealing fin 19, as measured on a Shore D scale, should be about 70 to 85. Further, the compressive strength of the closure material is another important parameter as is the width of the sealing end wall 35. That is, the capping torques in the range of 15 to about 25 inch pounds applied over 0.003–0.005 inch wall 35 should generate shear forces considerably in excess of the 5,000 to 8,000 psi compressive strength for polypropylene. As the plastic deforms at the end wall 35, the width of the sealing tip, which is about 0.003–0.005 of an inch in this instance, broadens with the residual torque then falling to between about 1,000 to 2,000 psig which corresponds to a residual torque of between about 6 to 8 inch pounds. This is below the compressive strength in the plastic which then stops deforming. Since the deformation stops with the sealing tip, the sealing pressure remains and the residual torque of about 6 to 8 inch pounds is maintained throughout the life of the closure package.

As explained previously, to prevent the threads 17 of the closure from stripping, the closure material must have sufficient flexural stiffness. It has been found that the preferred plastic should be a flexural stiffness of at least 175,000 psi and preferably in the range of 180,000 to 230,000 psi.

One suitable material which has the desired combination of compressive strength, hardness and flexural stiffness, is polypropylene. Medium impact polystyrene has not been found to be adequate because its Shore hardness indicates it is too hard although such polystyrene has a compressive strength of 11,000 and 16,000 psi. High density polyethylene lacks requisite flexural stiffness although it has suitable compressive strength and hardness.

Figure 3:
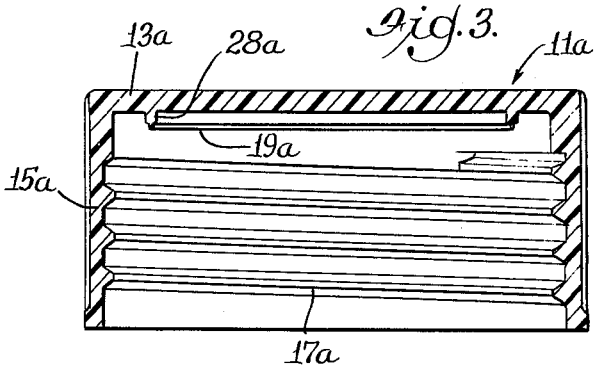
FIG. 3 is a cross-sectional view of a linerless closure in accordance with another embodiment of the invention.
Figure 4:
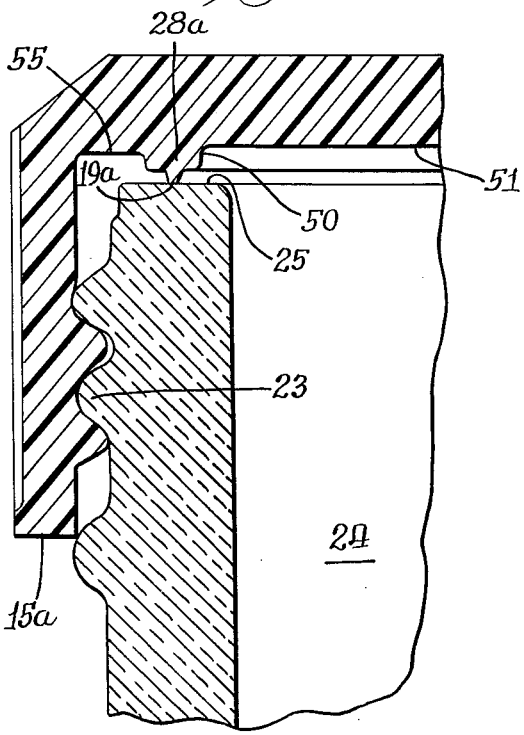
FIG. 4 is a fragmentary cross-sectional view of the closure of FIG. 3 in sealing engagement with a glass finish on a glass container.
Figure 5:
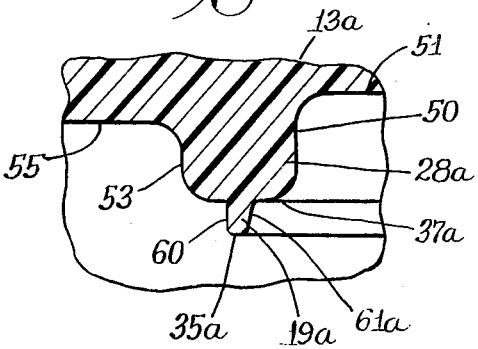
FIG. 5 is an enlarged cross-sectional fragmentary view of the sealing fin and base ring means of the closure of FIG. 3.

Referring now to FIGS. 3, 4 and 5, a second embodiment of the invention will be described using reference characters with the suffix "*a*" added to designate elements identical to those previously described in connection with the first embodiment of the invention.

The closure **11*a* is formed with a base ring means 28*a* which lacks a tapered cross section such as described above for the base ring means 28, which is more annular in shape and provides a rigid annular support immediately behind the thin sealing fin 19*a*. The latter is adapted to be crushed against the flat finish 25 of the container, as best seen in FIG. 4. The preferred and illustrated base ring means 28*a* is defined between a vertically extending, inner, circumferential wall 50 (FIG. 5) which is joined at an upper curved fillet to central circular under surface 51 of the top end wall 13*a*. This under surface 51 is disposed generally parallel to the top surface of the end wall and without any tapered wall as in the FIG. 1 embodiment. The outer side of the base ring means 28*a* is defined by an outer circumferentially extending wall 53 which extends upwardly to an outer under surface 55 which extends outwardly to a juncture with the skirt wall 15*a***.

By way of example only, the thickness of the base ring means **28*a* between the inner and outer circumferential walls 50 and 53 is 0.074" in this instance. The base ring means 28*a* is also substantially thicker in depth than the depth of the sealing fin 19*a*. For example, the depth or height of the depending base ring means 28*a* in this instance is about 0.035" from the top wall surface 51 to the wall 37*a* and is about 0.025" in depth between the wall 55 and the surface 37*a***, whereas the sealing fin has a depth of only about 0.010 inch in this illustrated embodiment.

The sealing fin **19*a* is preferably formed with a flat tip 35*a* which is also about 0.003–0.005 in width. The outer side wall 60 of the illustrated fin 19*a* is disposed generally vertically, i.e., axially, so as to be substantially perpendicular to the lower end wall 37*a* of the base ring means 28*a*. On the other hand, the opposite inner side wall 61*a* is inclined at an angle to the vertical, such as between 11° to 18°. The outer wall 60 was made vertical or flat to impart a preferential direction of deformation of the plastic. More specifically, it was desired that during the crushing of the sealing fin 19 that the plastic was forced outwardly in a radially outward direction. Such preferential direction of crushing is optional because the preferred height of the sealing fin 19***a* is only 0.010" and there is relatively little plastic shoved outwardly with most of the crushed plastic conforming to the glass finish 25.

The closure 11*a* is likewise formed from polypropylene having the same flexural stiffness, hardness and compressive strength as above described for the closure 11. Preferably, both closures have a relatively nominal 0.060 inch thick top wall at the center thereof and have about 0.085 to 0.095 inch thick cross-sectional wall when the ring means 28 or 28*a* is added thereto.

From the foregoing, it will be seen that the present invention makes possible the formation of a linerless closure with a small crushable sealing fin which is backed by a ring means during the crushing of the sealing fin into the finish of a glass container. The preferred ring means includes a downwardly and outwardly tapered surface which facilitates the flow of plastic across relatively large areas of metal in the mold and into the relatively small sealing fin cavity. Closures of this kind may be made economically and on a high volume basis. The present invention is particularly useful in the manufacture of large closures, e.g., 38 mm or larger, used on larger sizes of glass bottles. In larger closures, the plastic tends to cool as it spreads radially outwardly in the mold from a centrally located inlet at the axis of the closure and this plastic becomes more difficult to fill into small mold cavities to form small sealing fins. The base ring means helps to fill such sealing fins.

The closure disclosed herein is more suited to use with a flat top finish wall than a tapered top finish wall. As disclosed in copending Roy application entitled "Linerless Closure With Crushable Seal" filed June 21, 1977, a larger size sealing fin may be swedged radially by the tapered glass finish as well as being crushed in the axial direction. Herein, there is no substantial sideway swedging of the plastic in a given direction by a tapered finish. The smaller sealing fin of the present invention is more difficult to fill than the large sealing fins disclosed in the copending application.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. A linerless closure for sealing a glass finish on a glass container having an external screw thread for threadably receiving said closure, said closure comprising a one-piece body of polypropylene having a top end wall for extending across the open top of a container, a dependent skirt wall integrally joined to said top end wall about the outer circumference of said top end wall, an integral screw thread formed on the inner side of said skirt wall for threading engagement with the external screw thread on a glass container, a rigid base ring means integral with and depending from said top wall, said base ring means having a substantially tapered cross section increasing in thickness in a radially outward direction, a rigid annular sealing fin having a downwardly tapered cross section integrally connected with and depending from said base ring means, a lower sealing end on said sealing fin for being crushed against the container finish to spread and to conform to irregularities in the container finish, said lower sealing end being substantially rigid and non-bending and being permanently deformed to a wider width when crushed, said base ring means having a substantially wider width than the upper end of said sealing fin and providing a substantially non-deformable support for said sealing fin, said sealing fin being crushed when used and non-returnable to its original shape after removal of said closure from a container, said crushed sealing fin being the only sealing member on said closure.

2. A linerless closure in accordance with claim 1 in which said sealing fin has a depth in the axial direction of the closure of about 0.010 inch or less and a width at its juncture with said base ring means of about 0.020 inch.

3. A linerless closure in accordance with claim 1 in which said closure is formed of a material having a Shore D hardness in the range of 70 to 85, a flexural stiffness in the range of 185,000 to 225,000 psi, and a compressive strength of less than 16,000 psi.

4. A linerless closure in accordance with claim 1 in which said base ring means has a width in the radial direction of several times the width of said sealing fin and a thickness in the downward direction of several times the thickness of the sealing fin in the downward direction.

5. The combination of a linerless closure and a glass container comprising: a container made of glass and having an external screw thread for threadably receiving said closure, a flat top surface on said container at its finish, said closure comprising a one-piece body of polypropylene having a top end wall for extending across the open top of a container, a dependent skirt wall integrally joined to said top end wall about the outer circumference of said top end wall, an integral screw thread formed on the inner side of said skirt wall for threading engagement with said external screw thread on a glass container, a rigid base ring means integral with and depending from said top wall, said base ring means being tapered in cross-sectional thickness with the thicker portion thereof at the juncture of the sealing fin and said base ring means, a rigid annular sealing fin having a downwardly tapered cross section integrally connected with and depending from said base ring means, a lower sealing end on said sealing fin for being crushed against the container finish to spread and to conform to irregularities in the container finish, said lower sealing end being rigid and non-bending and being permanently deformed into a wider width when crushed, said base ring means having a substantially wider width than the upper end of said sealing fin and providing a substantially non-deformable support for said sealing fin, said sealing fin being the only sealing member on said closure.

6. A linerless closure in accordance with claim 5 in which said closure is 38 mm or greater in diameter.

* * * * *